US005769774A

United States Patent [19]

Beck et al.

[11] Patent Number: 5,769,774

[45] Date of Patent: Jun. 23, 1998

[54] FOLDER WITH RECYCLING FEED PATH

[75] Inventors: Christian A. Beck, Ridgefield, Conn.; Carl A. Miller, East Parrish, Fla.

[73] Assignee: Pitney Bowes Inc., Stamford, Conn.

[21] Appl. No.: 885,430

[22] Filed: Jun. 30, 1997

Related U.S. Application Data

[63] Continuation of Ser. No. 635,488, Apr. 22, 1996, abandoned.

[51] Int. Cl.[6] ..... B65H 45/14

[52] U.S. Cl. ..... 493/421; 493/419; 493/420

[58] Field of Search ..... 493/417, 419, 493/420, 421, 418, 422; 276/45, 51

[56] References Cited

U.S. PATENT DOCUMENTS

| | | | |
|---|---|---|---|
| 2,589,436 | 3/1952 | Rouan et al. | 270/68 |
| 2,766,040 | 10/1956 | Hanson et al. | 270/68 |
| 4,402,679 | 9/1983 | Heina | 493/420 |
| 4,781,367 | 11/1988 | Stab | 270/45 |
| 4,842,574 | 6/1989 | Noble et al. | 493/421 |
| 4,898,570 | 2/1990 | Luperti et al. | 493/420 |
| 4,900,391 | 2/1990 | Mandel et al. | 270/45 |
| 5,006,195 | 4/1991 | Martin et al. | 493/421 |
| 5,076,556 | 12/1991 | Mandel | 493/421 |
| 5,147,275 | 9/1992 | Staniszewski | 493/419 |
| 5,183,246 | 2/1993 | Edwards et al. | 270/45 |
| 5,263,708 | 11/1993 | Hacknauer | 493/419 |
| 5,316,280 | 5/1994 | Watkiss | 270/45 |
| 5,364,332 | 11/1994 | Gray, Jr. | 493/23 |
| 5,425,696 | 6/1995 | Hara et al. | 493/419 |
| 5,487,718 | 1/1996 | Staniszewski | 493/421 |

*Primary Examiner*—Joseph J. Hail, III
*Assistant Examiner*—Christopher W. Day
*Attorney, Agent, or Firm*—Angelo N. Chaclas; Melvin J. Scolnick

[57] ABSTRACT

An apparatus for forming one or more folds in a sheet having a trailing edge and a leading edge. The apparatus including: a device for forming a buckle in the sheet, a mechanism for folding the sheet along the buckle, and an auxiliary feed path for directing the leading edge of the sheet out of contact with the folding mechanism and returning the sheet back to the buckle forming device. In the preferred embodiment, the folding mechanism includes a first folder roller and a second fold roller and the auxiliary feed path is race track shaped. Additionally, the auxiliary feed path may include: a first pathway, a second pathway which is longer in length than the first pathway and a gate for controlling whether the sheet enters the first pathway or the second pathway depending upon the length of the sheet.

9 Claims, 5 Drawing Sheets

FOLDER WITH RECYCLING FEED PATH

CROSS REFERENCE TO RELATED APPLICATIONS

This application is a continuation of application Ser. No. 08/635,488, filed Apr. 22, 1996, now abandoned.

FIELD OF THE INVENTION

This invention relates to apparatus for folding sheets of material, commonly referred to as folders.

BACKGROUND OF THE INVENTION

In the field of sheet material handling, folders are well known. Oftentimes, it is desirable to place one or more folds in a sheet or a plurality of sheets. Typically, the sheets may be made of paper, plastic, fabric or some other material. The folders have been developed to automate the folding process and thus obtain operational efficiencies over manual methods which tend to be labor intensive, costly and slow.

In the mail preparation field, buckle chute folders are well known. Typically, a buckle chute folder comprises four or more fold rollers operating in cooperation with two or more buckle chutes and deflectors to place a sequence of folds in one or more sheets. A conventional buckle chute also includes a stop which is adjustably positioned within the chute for folding the sheets at a particular dimension or distance from the leading edge of the sheet. In operation, a first pair of rollers feeds a stack of sheets (or a single sheet) into the first buckle chute. When the leading edge of the stack hits the stop in the chute, forward progress of the stack ceases. However, the first pair of rollers continue to feed the stack causing a buckle to form in a predetermined location along the length of the stack near the entrance to the buckle chute. As the buckle grows, it enters the nip between another pair of rollers which are positioned adjacent the predetermined location. These rollers fold the stack along the buckle and feed the stack out of the buckle chute. This process is then repeated in subsequent downstream buckle chutes to produce more than one fold in the stack.

An example of a buckle chute folder, as described above, is found in U.S. Pat. No. 5,183,246 which discloses a buckle chute folder for use in an inserting system for producing a large volume of mailpieces. Referring particularly to FIG. 2 of the '246 patent, a plurality of fold roller pairs used in cooperation with a corresponding number of buckle chutes for use in producing multiple folds in a single sheet or stack of sheets are shown. Thus, this is an example of a high volume folder. Although this folder generally works well, it suffers from several drawbacks. First, the buckle chutes occupy a large amount of space which increases the overall size of the folder. Second, the large number of rollers and buckle chutes necessary to produce multiple folds add significantly to the overall cost of the folder.

Another example of a buckle chute folder is found in U.S. Pat. No. 4,842,574 which discloses a table top or low volume folding system typical of a small volume environment. Referring particularly to FIG. 3 of the '574 patent, a plurality of fold roller pairs used in cooperation with a plurality of buckle chutes for producing multiple folds are shown. Therefore, this folder suffers from the same space and cost drawbacks as those discussed above. Importantly, size and cost are generally more of a concern in table top systems than in high volume systems.

Still another example of a buckle chute folder is found in U.S. Pat. No. 5,076,556. This patent represents a departure from the previously discussed patents. Here, a single buckle chute is used in cooperation with the fold rollers for producing multiple folds in the sheet. Referring particularly to FIGS. 4, 9, 12 and 15 of the '556 patent, a recirculating device is disclosed which returns a once folded sheet back into the buckle chute in order to form a second fold. Thus, the cost of additional buckle chutes to form multiple folds is saved.

However, the folder of the '556 patent still suffers from several drawbacks. First, it utilizes an extremely large or oversized roller to produce folds and also acts as the recirculating device. This adds to the cost of the system. Since fold rollers are made from highly specialized materials and must have operating properties within a narrow range in order to be effective, they are costly to produce. Thus, because the oversized roller requires so much more material than a standard size roller (typically about 2.0 inches in diameter), it will be more costly than the standard size roller. Additionally, the oversized roller will require greater motor torque to stop and start due to its increased inertia. Therefore, a larger capacity motor or drive system will be required to operate with the oversized roller which will also add to the cost of the system. As a result, the cost savings of eliminating some of the buckle chutes will be reduced or possibly surpassed by the cost increases associated with the oversized roller. Second, the oversized roller adds to the size of the system because the circumference of the oversized roller is used to create the recirculation path. Since all the space inside the roller is occupied by the roller itself, this space is unavailable for other uses and is wasted.

Therefore, there is a need for a folder which substantially overcomes the disadvantages and drawbacks associated with the prior art folders. Particularly, there is a need for a folder having a reduced size and lower cost than the currently available folders.

SUMMARY OF THE INVENTION

Accordingly, it is an object of the present invention to provide a folder which substantially overcomes or alleviates the disadvantages and drawbacks, of the prior art folders.

In accomplishing these and other objects there is provided an apparatus for forming one or more folds in a sheet having a trailing edge and a leading edge. The apparatus including: means for forming a buckle in the sheet, means for folding the sheet along the buckle, and an auxiliary feed path means for directing the leading edge of the sheet out of contact with the folding means and returning the sheet back to the buckle forming means. In the preferred embodiment, the folding means includes a first folder roller and a second fold roller and the auxiliary feed path means is race track shaped. Additionally, the auxiliary feed path means may include: a first pathway, a second pathway which is longer in length than the first pathway and a gate means for controlling whether the sheet enters the first pathway or the second pathway depending upon the length of the sheet.

Therefore, it is now apparent that the invention achieves all the above objects and advantages. Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention. As shown throughout the drawings, like reference numerals designate like or corresponding parts.

DETAILED DESCRIPTION OF THE PREFERRED EMBODIMENT

Figure 1:
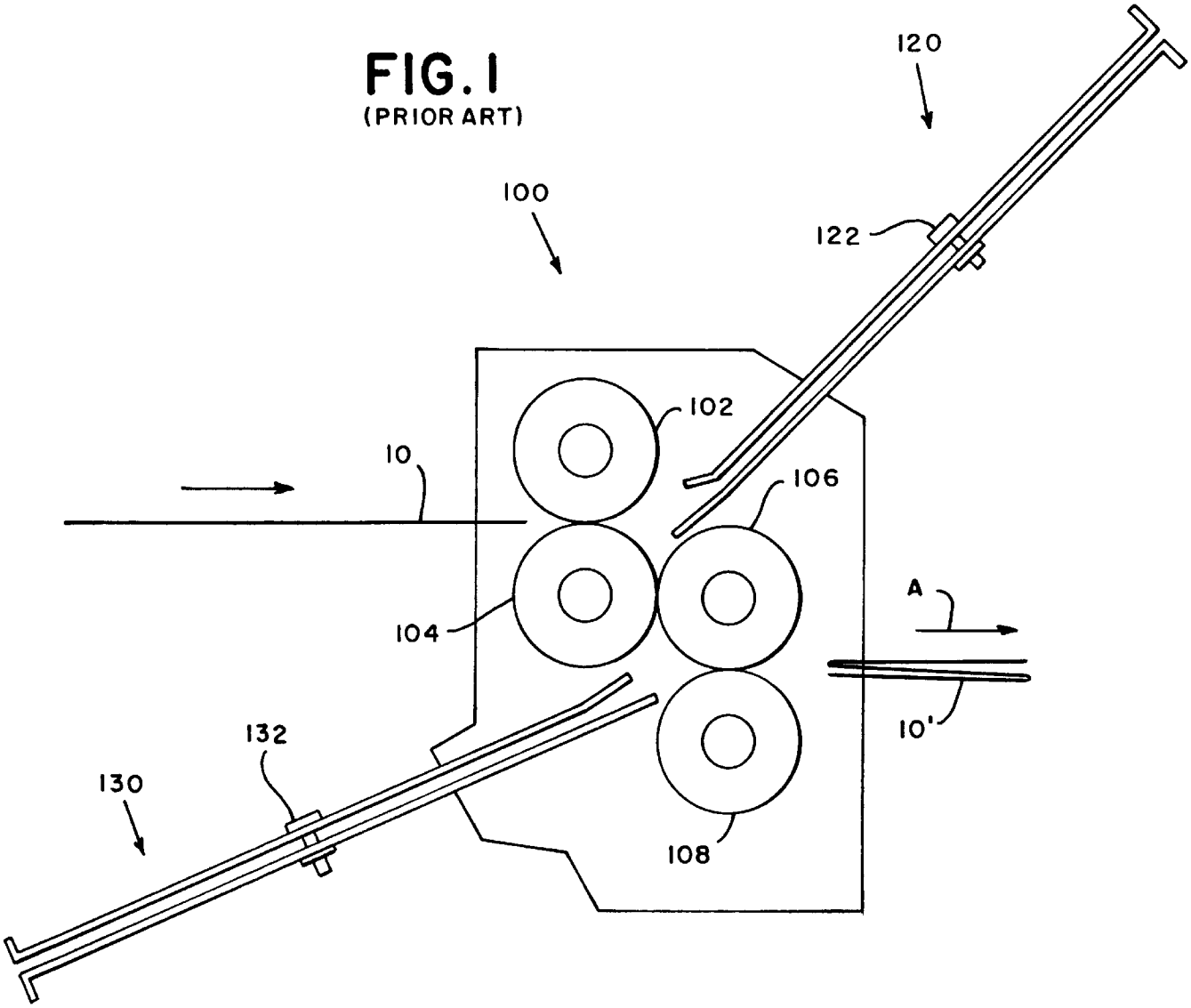
FIG. 1 (PRIOR ART)
FIG. 1 is a simplified illustration of an elevational view of a prior art folder.

Referring to FIG. 1, a prior art folder 100 is shown which is representative of one of the types of folders discussed above. The folder 100 includes a plurality of fold rollers 102, 104, 106 and 108 and a plurality of buckle chutes 120 and 130. A sheet 10 enters the folder 100 as indicated by the arrow and exits the folder 100 in a Z-fold configuration as shown by sheet 10'. The sheet 10 is fed through the nip of a first pair of rollers 102 and 104 into buckle chute 120 until it encounters a stop 122 spaced along the length of the buckle chute 120. Then, a buckle forms in the sheet 10 which is fed through the nip of a second pair of rollers 104 and 106. Rollers 104 and 106 feed the sheet 10 into buckle chute 130 until the sheet 10 encounters stop 132 spaced along the length of the buckle chute 130. Again, a buckle forms in the sheet 10 which is fed through the nip of a third pair of rollers 106 and 108. Rollers 106 and 108 feed the sheet 10 out of the folder 100.

Figure 2:
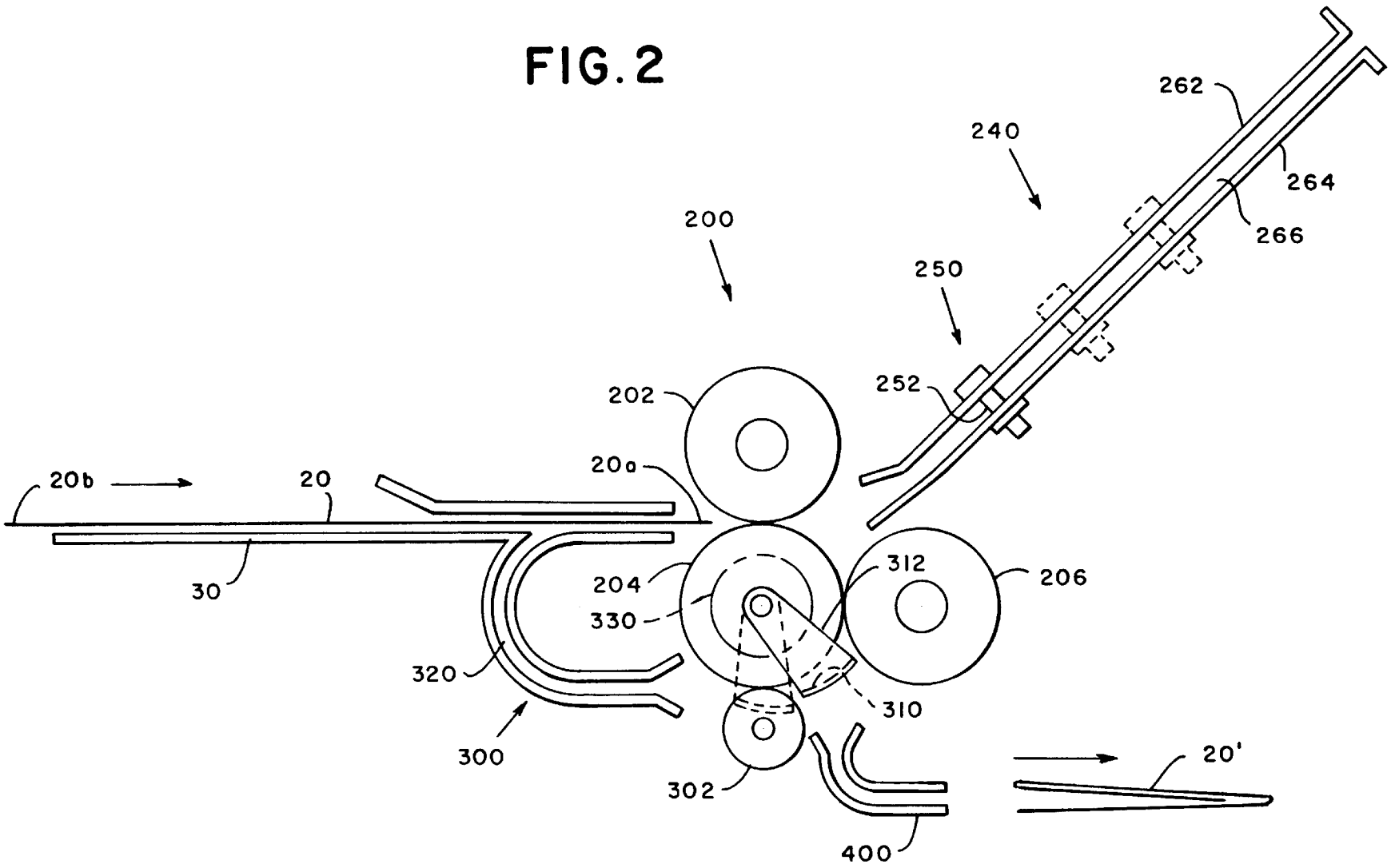
FIG. 2 is a simplified illustration of an elevational view of a folder in accordance with a first embodiment of the present invention.

Referring to FIG. 2, a folder 200 in accordance with a first embodiment of the present invention is shown. The folder 200 includes fold rollers 202, 204 and 206, a drive system (not shown) for causing the fold rollers to rotate, a buckle chute assembly 240 and a recycling assembly 300. The drive system may be of any suitable conventional design such as a motor and pulley based system. A sheet or stack of sheets 20 having a leading edge 20*a* and a trailing edge 20*b* is fed along deck 30 and enters the folder 200 as indicated by the arrow and exits the folder 200 in the configuration shown by sheet 20'. However, other configurations for the sheet 20' are achievable based upon the setup of the folder 200 which will be discussed in more detail below.

The buckle chute assembly 240 includes a pair of plates 262 and 264 which form a sheet receiving path 266 therebetween and a conventional stop assembly 250 adjustably and slideably mounted to the plates 262 and 264 so as to be repositionable along the length of the plates 262 and 264. The stop assembly 250 includes an obstructing surface 252 located within the path 266 for stopping the forward progress of the leading edge 20*a* of the sheet 20. Once the leading edge 20*a* hits the surface 252, a buckle forms in the sheet 20 which is then fed through rollers 204 and 206. Alternatively, the stop assembly 250 may be relocated to a plurality of positions along the plates 262 and 264, such as those indicated in dashed lines. Thus, the fold is created at a predetermined distance from the leading edge 20*a* of the sheet 20 depending upon the position of the stop assembly 250. In this manner, the location along the sheet 20 where the buckle forms may be controlled and different fold configurations achieved, such as: Z-fold, C-fold and half folds.

The recycling assembly 300 provides an auxiliary feed path 320 having an outside guide 320*a* and an inside guide 320*b* for guiding the sheet 20 back to the buckle chute assembly 240. The recycling assembly 300 includes a deflector 310 attached by an arm 312 to a rotary solenoid 330, an idler roller 302 and an auxiliary feed path 320. Alternatively, the arm 312 could be relocated to pivot about roller 206 and serve in the same capacity.

The deflector 310 is shown in position to cause the sheet 20 to pass between rollers 204 and 302 and enter the auxiliary feed path 320 as the sheet 20 is fed from rollers 204 and 206. The auxiliary feed path 320 directs the sheet 20 away from rollers 204 and 206. As the sheet 20 travels along path 320, it will feed back through rollers 202 and 204 which will once again cause the sheet 20 to enter the buckle chute assembly 240. Alternatively, the solenoid 330 can selectively reposition the deflector 310 to that shown in dashed lines so that the sheet 20 bypasses the auxiliary feed path 320 and instead enters exit chute 400.

Since the sheet 20 will contact and generally conform to the shape of the outside wall 320*a*, the exact shape of inside wall 320*b* is not critical. For example, a large portion of inside wall 320*b* may not be necessary at all because the sheet 20 is in intimate contact with outside wall 320 until the sheet 20 returns to deck 30.

Figure 3A:
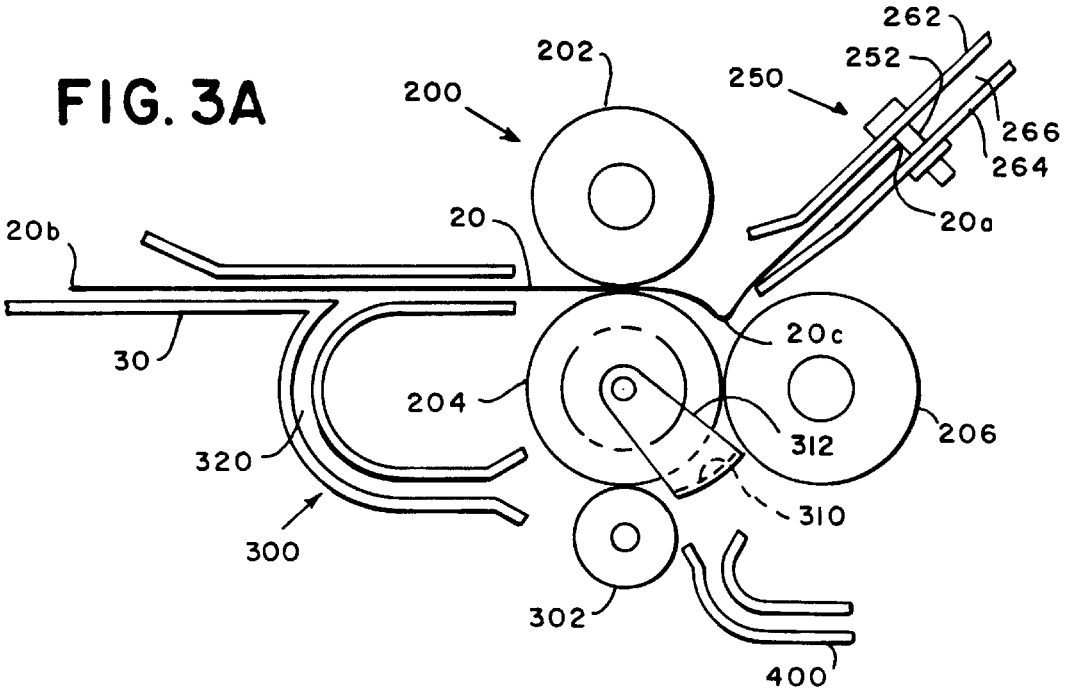
FIGS. 3A–3E are a sequence of simplified illustrations along the same vantage point as taken in FIG. 2 which are representative of the folder performing one cycle of operation where two folds are performed on a sheet in accordance with the first embodiment of the present invention.

With the basic structural components of the first embodiment of the present invention described, the operational characteristics will now be described with reference to FIGS. 3A–3E which depict the generation of a C-fold in the sheet 20. Referring to FIG. 3A, the stop assembly 250 is positioned along the plates 262 and 264 in what is commonly referred to as a ⅓ stop position. In the ⅓ stop position, the distance between the leading edge 20*a* of the sheet 20 and a resulting buckle 20*c* is one third of the total length of the sheet 20 from the leading edge 20*a* to the trailing edge 20*b*. As the buckle 20*c* forms, it enters into the nip between rollers 204 and 206. Located downstream from and adjacent to the nip of roller 204 and 206, the deflector 310 is in the deflect position.

Figure 3B:
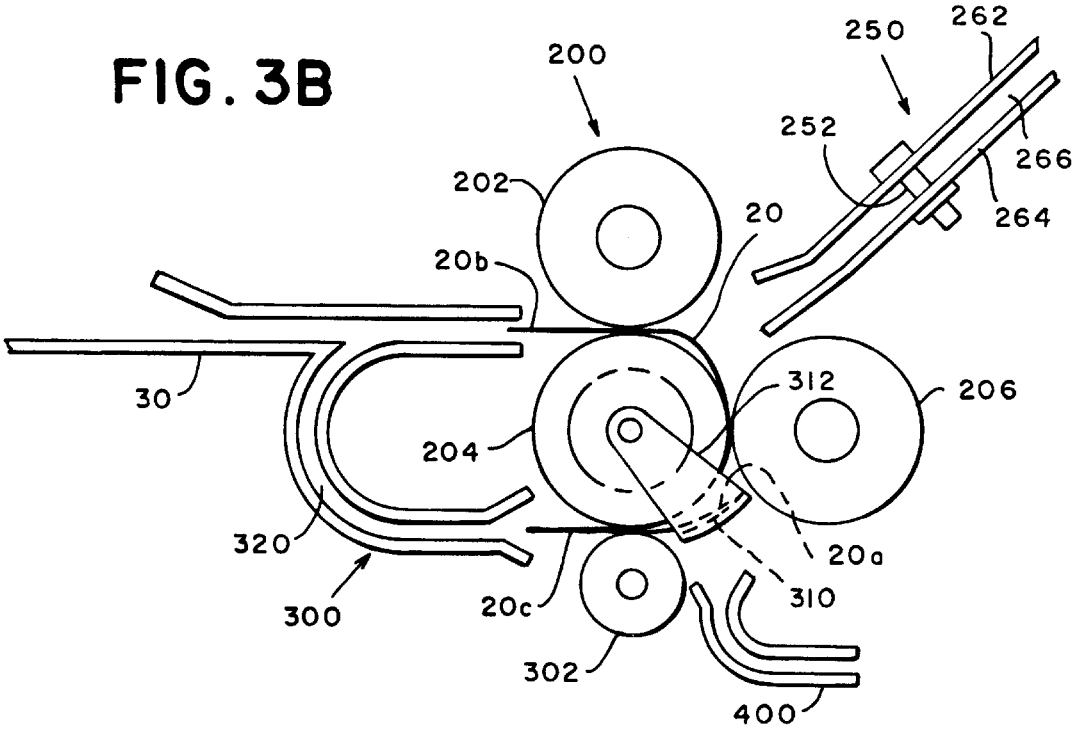

Referring to FIG. 3B, the sheet 20 has been folded along the buckle 20*c* and buckle 20*c* has become the new leading edge of the sheet 20. Deflector 310 guides or deflects edge 20*c* to pass between rollers 204 and 302. Accordingly, the sheet 20 enters the auxiliary path 320. Thus, the edge 20*c* loses contact with the rollers 204, 206 and 302 and instead travels along path 320. As the rollers 204 and 302 continue to feed the sheet 20, more and more of the sheet will lose contact with the rollers 204, 206 and 302.

Figure 3C:
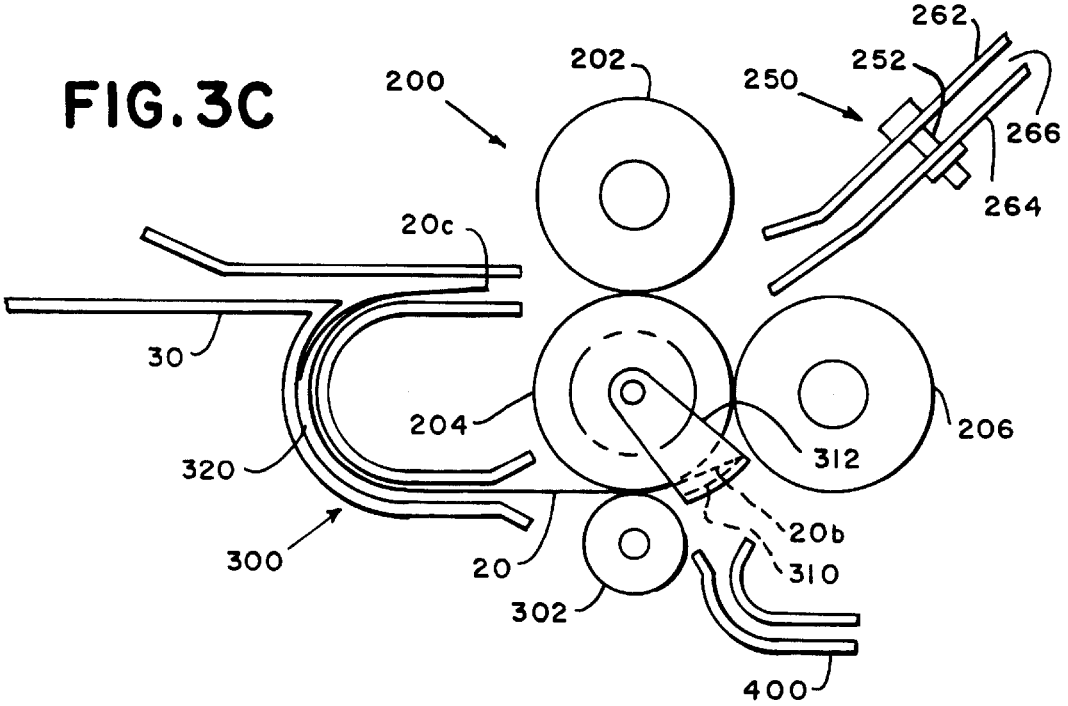
Figure 3D:
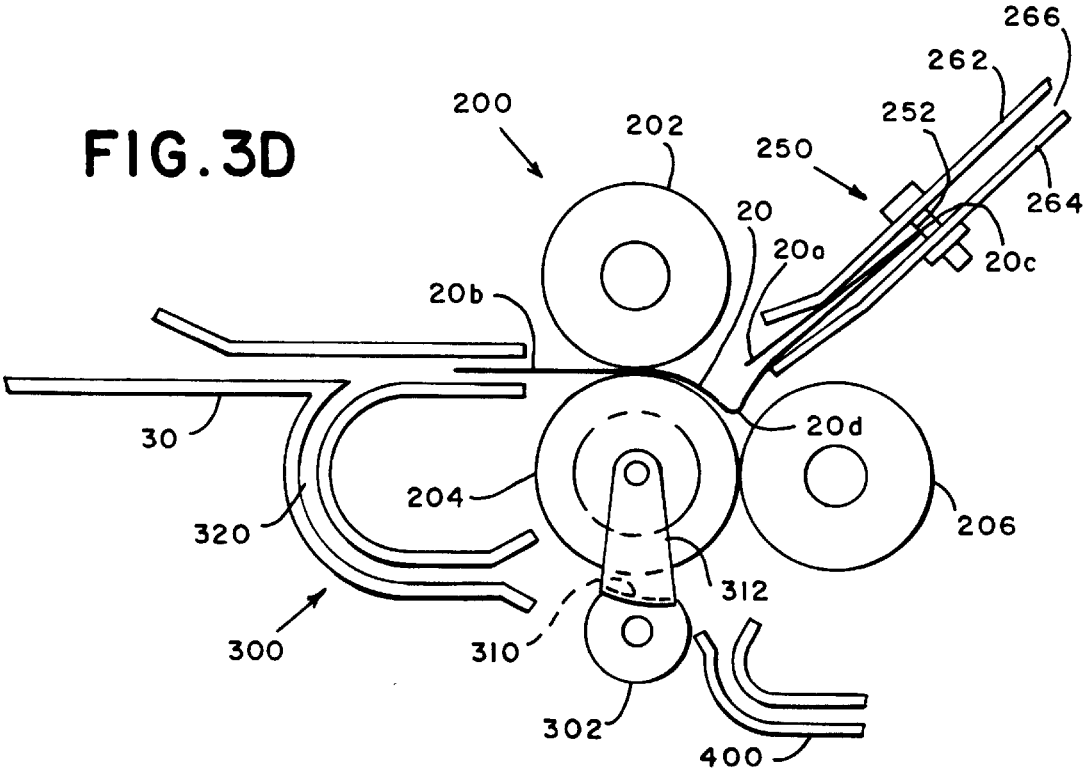

Referring to FIG. 3C, the sheet 20 continues to feed along the auxiliary path 320 and is directed back toward rollers 202 and 204. It should be noted that the overall length of the auxiliary path 320 is important to the overall operation of the folder 200. The length of the auxiliary path 320 must be sufficiently great enough to ensure that the trailing edge 20*b* of the sheet 20 clears the nip between rollers 202 and 204 before the edge 20*c* reaches the nip between rollers 202 and 204. Otherwise, a jam will likely result from the sheet 20 becoming wrapped around itself. On the other hand, the length of the auxiliary path 320 must not be so great that the trailing edge 20*b* of the sheet 20 clears the nip between rollers 204 and 302 before the edge 20*c* reaches the nip between rollers 202 and 204. Otherwise, a jam will likely result from the sheet 20 having insufficient length and drive to reach rollers 202 and 204 and thus becoming stalled in the auxiliary path 320. Therefore, the length of the auxiliary path 320 must be selected appropriately based upon the overall length of the sheet 20 being fed and the type of fold required.

Referring to FIG. 3D, the sheet 20 again is fed by rollers 202 and 204 into the space 266 between plates 262 and 264. This time, edge 20*c* hits the obstructing surface 252 and a new or second buckle 20*d* forms in the sheet 20 in proximity to edge 20*a*. As before, the buckle 20*d* is drawn toward the nip of rollers 204 and 206. However, by this time, solenoid 330 has repositioned the deflector 310 to the bypass position.

Figure 3E:
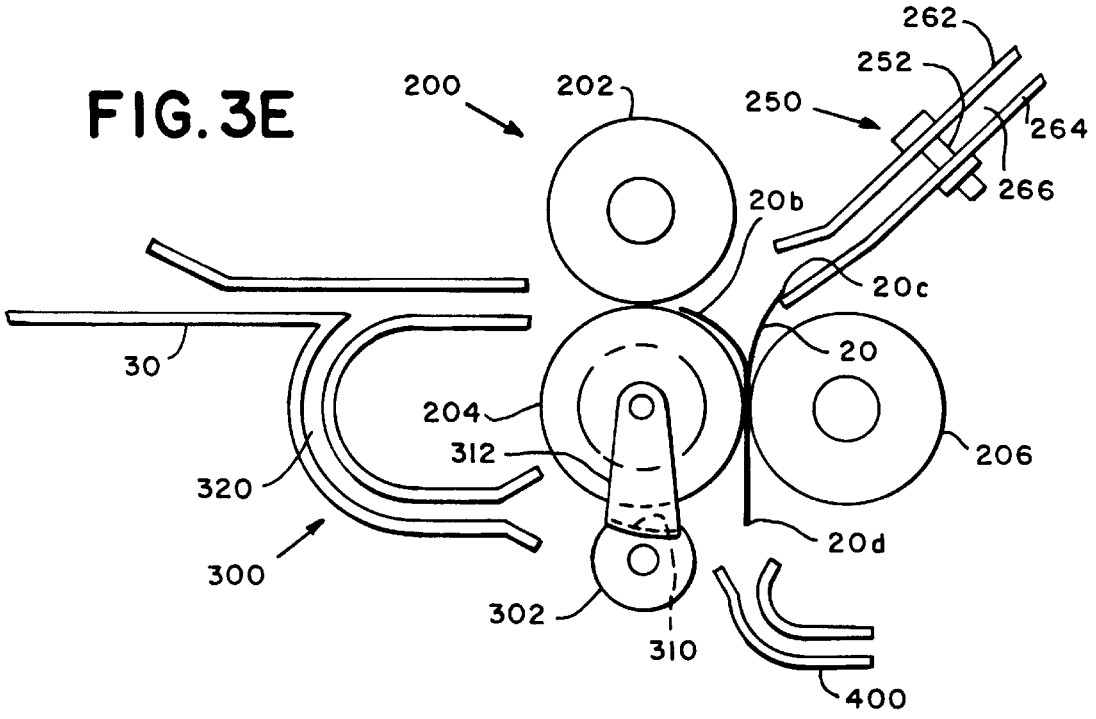

Referring to FIG. 3E, rollers 204 and 206 have folded the sheet 20 along the buckle 20*d* and edge 20*d* results. Because the deflector 310 is in the bypass position and out of the feed path of the sheet 20, the sheet 20 is about to enter the exit chute 400. Therefore, the auxiliary feed path 320 will be skipped or bypassed as the sheet is fed from rollers 204 and 206.

It should now be apparent to those skilled in the art that the present invention substantially alleviates the disadvantages and drawbacks of the prior art shown in FIG. 1 and U.S. Pat. Nos. 5,183,146, 4,842,574 and 5,076,556. First, by recycling the sheet 20 back through the buckle chute assembly 240, significant space and cost savings are achieved. Second, the use of the auxiliary feed path 320 allows all the fold rollers 202, 204 and 206 to be of standard size while roller 302 is merely a small and inexpensive idler roller. Third, because the fold rollers 202, 204 and 206 are of standard size, torque requirements on the drive system are maintained at traditional levels. Fourth, the auxiliary feed path 320 may be designed to reduce its impact on the overall size of the folder 200. For example, in the preferred embodiment, the auxiliary feed path 320 has been tucked underneath the deck 30. Additionally, in the preferred embodiment, the auxiliary feed path 320 has been designed in a race track shape. This geometric shape will occupy less space for an equivalent feed path length than a circle (as in U.S. Pat. No. 5,076,556) will. The mathematical proof for this position appears below. Thus, for all of these reasons, the present invention achieves significant space and cost savings over the prior art shown in FIG. 1 and U.S. Pat. Nos. 5,183,146, 4,842,574 and 5,076,556. Those skilled in the art will likely observe still further advantages of the present invention.

Figure 4:
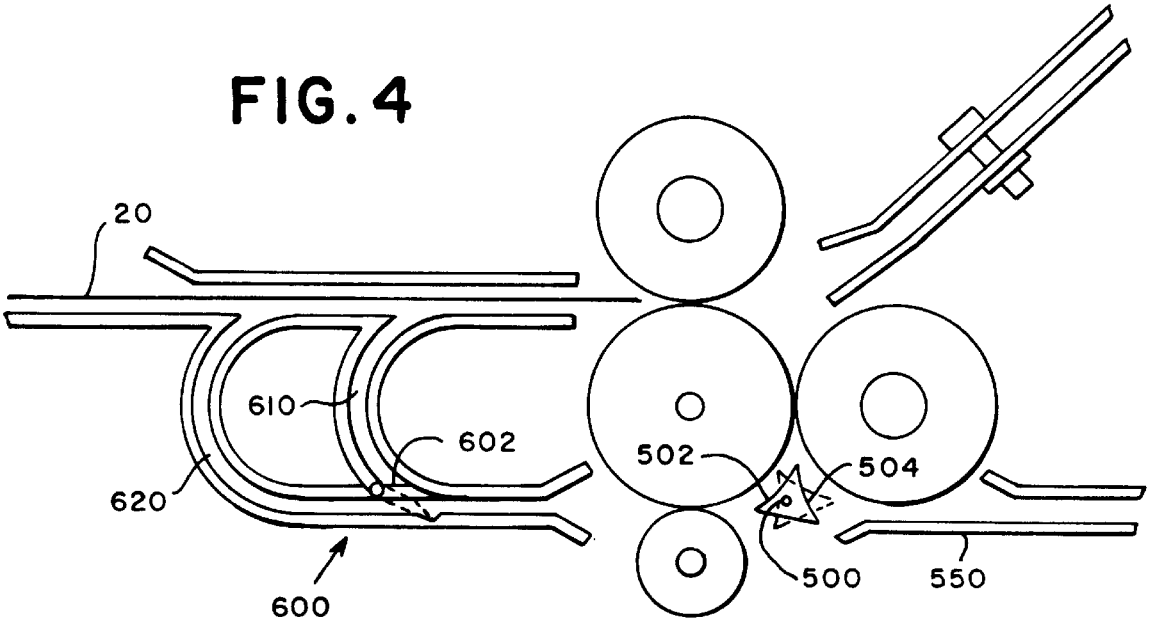
FIG. 4 is a simplified illustration of an elevational view of a folder in accordance with a second embodiment of the present invention.

Referring to FIG. 4, a second embodiment of the present invention is shown. In this embodiment, a deflector 500 having a deflection surface 502 and a bypass surface 504 is shown in a deflection position. The deflection surface 502 guides the sheet 20 into an auxiliary path assembly 600 while the bypass surface 504 guides the sheet 20 into an exit chute 550. Any suitable conventional structure, such as a rotary solenoid (not shown), can be used to reposition the deflector 500 between the deflection position where the deflection surface 502 is operative and a bypass position, shown in dashed lines, where the bypass surface is operative. The auxiliary path assembly 600 includes a first pathway 610, a second pathway 620 and a gate 602 which controls which of the first and second pathways 610 and 620 that the sheet 20 enters. The gate 602 is in position to allow the sheet 20 to skip the first pathway 610 and enter the second pathway 620. However, the gate 602 is repositionable by any conventional structure to assume the position shown in dashed lines to cause the sheet 20 to enter the first pathway 610.

In operation, sheets 20 having a short length, 11 inches or less, will pass through the first pathway while those having a long length, 14 inches or more, will pass through the second pathway 620. In this manner, overall throughput of the system is increased because the length of the first pathway 610 can be optimized for short sheets. However, once optimized, the first pathway will likely no longer be appropriate for long sheets due to the reasoning discussed above. Thus, the second pathway 620 is provided. Those skilled in the art will recognize that by adding more pathways and gates, or by making the assembly adjustable in the horizontal direction, any number of different length sheets 20 can be optimized.

Many features of the preferred embodiment represent design choices selected to best exploit the inventive concept as implemented in a buckle chute folder employing flat plates. However, the present invention is applicable to other buckle chute folders employing curved buckle chute plates. Additionally, the present is applicable to still other folders employing other types of buckle forming means. For example, the present invention may be incorporated with a knife type and soft nip buckle forming means as described in U.S. Pat. Nos. 5,076,556 and 5,364332, respectively.

Additionally, those skilled in the art will recognize that the auxiliary feed path described in the present invention may be turned from a passive system (not driven) to an active system by adding driven rollers, belts or O-rings to assist the sheet 20 in moving through the paths 320, 610 and 620.

Moreover, still further advantages and modifications will readily occur to those skilled in the art. Therefore, the invention in its broader aspects is not limited to the specific details of the preferred embodiment. Accordingly, various modifications may be made without departing from the spirit of the general inventive concept as defined by the appended claims and their equivalents.

All references cited within this application, along with their respective references, are specifically incorporated herein by reference and constitute a part of the present disclosure.

What is claimed is:

1. An apparatus for forming at least first and second fold lines in a sheet having a leading edge, comprising:

a first and a second roller defining a first nip for feeding the sheet into a buckle chute to produce a first buckle in the sheet;

the second roller and a third roller defining a second nip for forming the first fold line along the first buckle, said second and third rollers having approximately identical diameters; and means defining an auxiliary feed path extending between the second nip and the first nip for guiding the leading edge of the sheet out of contact with the second and third rollers and returning the sheet back to the first nip formed by the first and second rollers so that the sheet reenters the buckle chute to produce a second buckle in the sheet and reenters the second nip forming by the second and third rollers to form the second fold line along the second buckle.

2. The apparatus of claim 1, comprising:

deflecting means repositionable between a first position and a second position for controlling whether the sheet enters the auxiliary feed path or bypasses the auxiliary feed path.

3. The apparatus of claim 2, wherein:

the means defining the auxiliary feed path includes a first pathway, a second pathway which is longer in length than the first pathway and a gate means for controlling whether the sheet enters the first pathway or the second pathway depending upon the length of the sheet.

4. The apparatus of claim 3, wherein:

the sheet has a trailing edge; and the second and third rollers feed the sheet along the auxiliary feed path so that the leading edge of the sheet enters the first nip formed by the first and second rollers before the trailing edge loses contact with the second and third rollers.

5. The apparatus of claim 4, further comprising:

an idler roller in operative engagement with one of the second and third rollers to form a nip therebetween so as to feed the sheet along the first pathway or the second pathway depending upon the position of the gate means.

6. The apparatus of claim 1, wherein:

the means defining the auxiliary feed path includes a first pathway, a second pathway which is longer in length than the first pathway and a gate means for controlling whether the sheet enters the first pathway or the second pathway depending upon the length of the sheet.

7. The apparatus of claim 6, comprising; deflecting means repositionable between a first position and a second position for controlling whether the sheet enters the auxiliary feed path or bypasses the auxiliary feed path.

8. The apparatus of claim 7, wherein:

the sheet has a trailing edge; and the second and third rollers feed the sheet along the auxiliary feed path so that the leading edge of the sheet enters the first nip formed by the first and second rollers before the trailing edge loses contact with the second and third rollers.

9. The apparatus of claim 8, further comprising:

an idler roller in operative engagement with one of the second and third rollers to form a nip therebetween so as to feed the sheet along the first pathway or the second pathway depending upon the position of the gate means.

* * * * *